US008100356B2

(12) United States Patent
Pirtle et al.

(10) Patent No.: US 8,100,356 B2
(45) Date of Patent: Jan. 24, 2012

(54) APPARATUS AND METHOD FOR WINDING FILM ONTO A FILM ROLL

(75) Inventors: Shaun Eugene Pirtle, Coweta, OK (US); Khurrum Shamsi, Tulsa, OK (US); Robert Earl Cochlin, Chouteau, OK (US)

(73) Assignee: Paragon Films, Inc., Broken Arrow, OK (US)

( * ) Notice: Subject to any disclaimer, the term of this patent is extended or adjusted under 35 U.S.C. 154(b) by 316 days.

(21) Appl. No.: 12/470,265

(22) Filed: May 21, 2009

(65) Prior Publication Data

US 2010/0012764 A1 Jan. 21, 2010

Related U.S. Application Data

(60) Provisional application No. 61/082,398, filed on Jul. 21, 2008.

(51) Int. Cl.
*B65H 18/28* (2006.01)

(52) U.S. Cl. ..... 242/160.4; 242/548.1; 428/121

(58) Field of Classification Search .... 242/548.1–548.2, 242/160.4; 428/121
See application file for complete search history.

(56) References Cited

U.S. PATENT DOCUMENTS

| | | | | |
|---|---|---|---|---|
| 4,252,154 | A * | 2/1981 | Alexander, III | 139/304 |
| 4,492,257 | A * | 1/1985 | Alexander, III | 139/304 |
| 4,763,852 | A * | 8/1988 | Smith | 242/615.2 |
| 5,013,595 | A | 5/1991 | Parry | |
| 5,417,382 | A | 5/1995 | Petitjean et al. | |
| 5,458,841 | A | 10/1995 | Shirrell | |
| 5,494,237 | A * | 2/1996 | Summey, III | 242/548.1 |
| 5,520,872 | A | 5/1996 | Scherer | |
| 5,531,393 | A | 7/1996 | Salzsauler et al. | |
| 5,565,222 | A | 10/1996 | Scherer | |
| 5,626,944 | A | 5/1997 | Rasmussen | |
| 5,967,437 | A | 10/1999 | Martin-Cocher et al. | |
| 6,102,313 | A | 8/2000 | Salzsauler et al. | |
| 6,170,772 | B1 | 1/2001 | Martin-Cocher et al. | |
| 6,375,781 | B1 | 4/2002 | Wojcik et al. | |
| 6,713,010 | B1 | 3/2004 | Doran et al. | |
| 2004/0048019 | A1 | 3/2004 | Ohlsson | |
| 2006/0243842 | A1 | 11/2006 | Saldana Garcia | |
| 2006/0289691 | A1 | 12/2006 | Forni | |
| 2007/0178278 | A1 | 8/2007 | Clarke | |

FOREIGN PATENT DOCUMENTS

| | | |
|---|---|---|
| CA | 2068908 | 6/2000 |
| CA | 2319302 | 4/2001 |
| CA | 2334401 | 8/2001 |

* cited by examiner

*Primary Examiner* — Sang Kim
(74) *Attorney, Agent, or Firm* — Gable Gotwals

(57) ABSTRACT

An issue with conventional stretch films is that the edges of the film can be easily damaged, which may result in tearing or failure of the film during use. Folding the film edges may reduce such damage but yields uneven rolls of film that are difficult to unwind. The present disclosure describes in-process devices, systems, and methods for oscillating the film to prevent stacking of the folded edges as the film is wound onto a film roll. The present disclosure also describes in-process devices, systems, and methods for entrapping air between the layers of film as they are wound onto a film roll. As a result, the film is less susceptible to damage and easier to use.

12 Claims, 3 Drawing Sheets

APPARATUS AND METHOD FOR WINDING FILM ONTO A FILM ROLL

CROSS-REFERENCES TO RELATED APPLICATIONS

This application claims the benefit of U.S. Provisional Patent Application, Ser. No. 61/082,398, filed on Jul. 21, 2008, the contents of which are hereby incorporated by reference in their entirety.

FIELD OF THE DISCLOSURE

The present disclosure generally relates to devices, systems, and methods for producing film in-process for use in the stretch film market. In particular, the present disclosure relates to in-process methods, systems, and devices for oscillating the film to prevent stacking of the folded edges as the film is wound onto a film roll. The present disclosure also relates to methods, systems, and devices for entrapping air between the layers of film as they are wound onto a film roll. As a result, the film is less susceptible to damage, requires less effort to unwind, and is easier to use.

BACKGROUND OF THE DISCLOSURE

Stretch films are widely used in a variety of bundling and packaging applications. For example, stretch films have become a common method of securing bulky loads such as boxes, merchandise, produce, equipment, parts, and other similar items on pallets. Stretch films are typically made from various polyethylene resins and may be single or multilayer products. An additive known as a cling agent is frequently used to ensure that adjacent layers of film will cling to each other.

An issue with conventional stretch films is that the edges of the film can be easily damaged, which may result in tearing or failure of the film during use. Typically, the edges of the film are prepared by transversely slitting individual roll widths of film from a wider width of film by means of a conventional sharp edge slitter assembly. Any defects that are introduced into the edges of the film during the slitting process can result in film failure during the application process. Dropping the film roll or any other abuse during handling may also create zones of weakness or tears in the edges of the film.

One method of reinforcing the edges of the film is to fold the edges of the film to form a hem. For example, U.S. Pat. No. 5,565,222 discloses an apparatus for hemming the edges of stretch film. The apparatus consists of a first hemming roller with a width less than the width of the film, guide bars located adjacent to the film's path of travel, and a second hemming roller. As another example, U.S. Pat. No. 5,531,393 discloses a film with folded edges. Folding is achieved by means of folding fingers that project inwardly from the side plates of the apparatus. In both of the previously mentioned methods, the folding is performed post-production in a separate and secondary process.

These hems, however, cause difficulties in winding a uniform roll of film due to the essentially double thickness of the hemmed edge as compared to the remainder of the film. Oscillating the film as it is wound onto the roll can prevent the hemmed edges from stacking on top of one another, thus producing a roll with uniform dimensions.

U.S. Pat. No. 5,531,393 discloses an apparatus where the roll onto which the film is wound is oscillated to prevent stacking of the folds in the film's edges. The oscillation is controlled by a piston reciprocating between two limit positions, which moves a cap inserted into the hollow end of the film roll. U.S. Pat. No. 5,967,437 discloses a means for oscillating the film, preferably by rectilinear motion of either the feed roller or the film roll along its axis. However, the disclosure results in film rolls with frustoconical or substantially conical end zones.

As can be seen, there is a need for methods, systems, and devices to produce uniform, flat rolls of film in-process so that they can be easily stored, transported, and used. There is also a need for methods, systems, and devices to make film rolls less susceptible to damage during shipment and use, thus reducing wastage. In addition, there is a need to facilitate the unwinding of the film, making the film easier for the operator to use.

SUMMARY OF THE DISCLOSURE

An in-process apparatus for oscillating and winding film onto a film roll is provided. The apparatus comprises a film with edge folds, an oscillating mechanism, and a winding mechanism comprised of a retractable idler roll and a film roll separated from the retractable idler roll by an air gap that remains constant as the film is wound onto the film roll.

An in-process method for winding film onto a film roll is further provided. The method comprises the steps of providing a film, a retractable idler roll, and a film roll separated from the retractable idler roll by an air gap that remains constant as the film is wound onto the film roll. The method further comprises the steps of moving the film over the retractable idler roll, passing the film across the air gap, and winding the film onto the film roll.

These and other features, aspects, and advantages of the present disclosure will become better understood with reference to the following drawings, description, and claims.

BRIEF DESCRIPTION OF THE DRAWINGS

The disclosure will be better understood from the following description and the accompanying drawings given as non-limiting examples, and in which.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the present disclosure is best defined by the appended claims.

Broadly, the current disclosure includes systems, devices, and methods for producing film in-process for use in the stretch film market. More specifically, according to an embodiment of the disclosure, an apparatus and method are provided for winding the film onto a film roll. Oscillating the film as it is wound may ensure that the edge folds do not stack up in one location and that the resulting film rolls are uniform and easy to unwind. The apparatus and method may further ensure that air is entrapped between the layers of film as the layers are wound onto the film roll. As a result, the layers of film may be less likely to stick together, making the film easier to use and less susceptible to damage.

Figure 1:
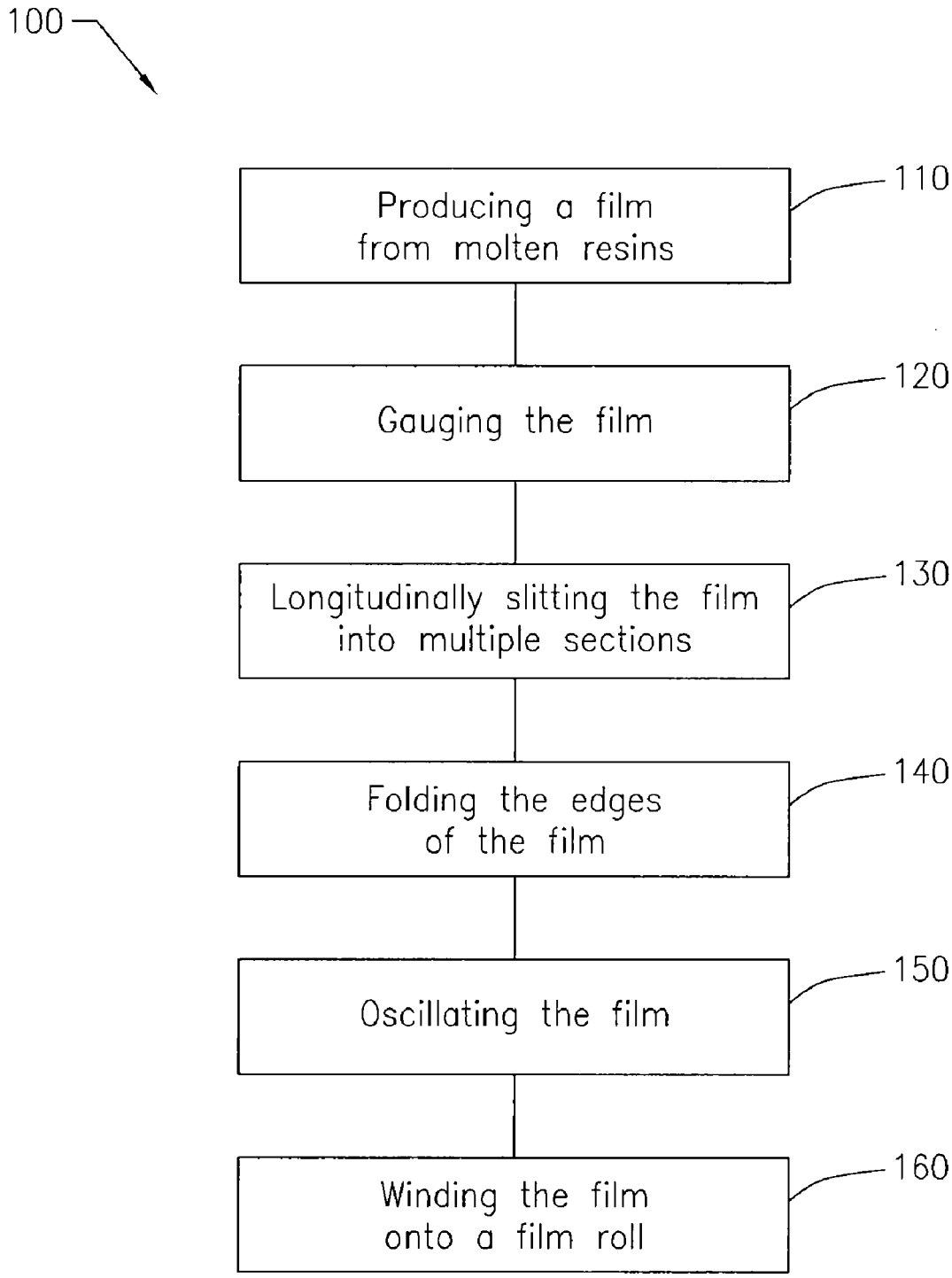
FIG. 1 illustrates the steps for producing film in-process, according to an embodiment described herein.

Referring generally to FIG. 1, the steps 100 for producing film in-process, according to the teachings of the present disclosure, are illustrated. Specifically, the steps comprise producing a film from molten resins 110, gauging the film 120, longitudinally slitting the film into multiple sections 130, folding the edges of the film 140, oscillating the film 150, and winding the film onto a film roll 160 in a manner that prevents stacking of the edge folds and entraps air between the layers of film. All of the steps may be performed along a single production line. The steps may be performed in a different order, and one or more steps may be eliminated without departing from the scope of the present disclosure.

As shown in FIG. 1, the film may be oscillated and wound onto film rolls after the edges of the film are folded. The present disclosure may use any conventional oscillating mechanism to oscillate the film. For example, the oscillating mechanism may be a frame that moves back and forth across a set distance in a controlled manner at a specified rate. The film may be supported by and move with the oscillating frame.

Figure 2:
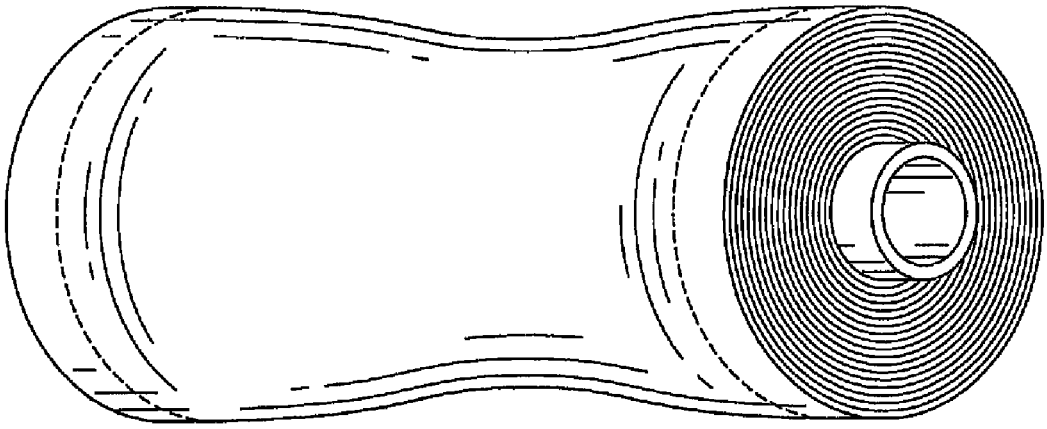
FIG. 2 PRIOR ART
FIG. 2 illustrates a film roll where the edge folds have stacked up during the winding process, according to the prior art.
Figure 3:
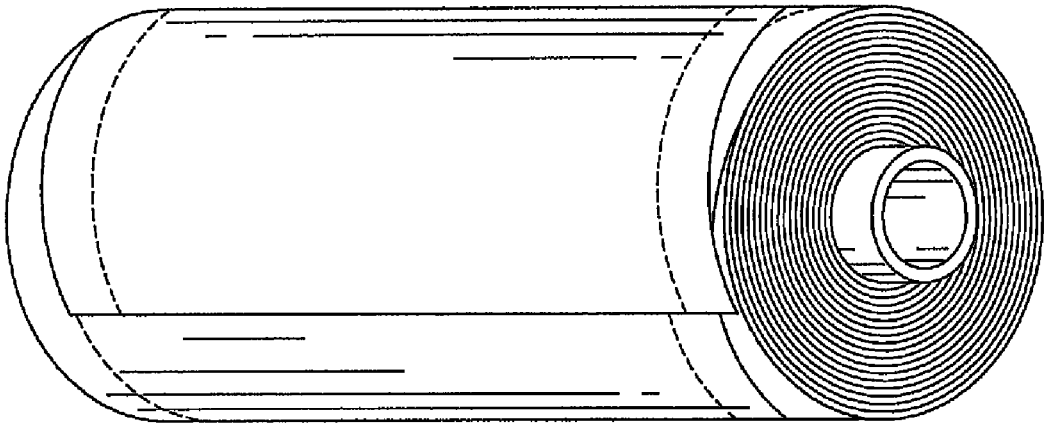
FIG. 3 illustrates a film roll where the film is oscillated to prevent the edge folds from stacking up during the winding process, according to an embodiment described herein.

Oscillation may efficiently distribute the edge folds onto the film roll. If the film is not oscillated, the edge folds will stack up in one location, producing a film roll with hard, raised edges as shown in FIG. 2. The hard, raised edges are susceptible to damage and prevent the film from unwinding properly, resulting in film rolls that are unusable. In contrast, oscillation produces film rolls that are generally uniform, as shown in FIG. 3, and easy to unwind.

To prevent the edge folds from stacking up, the film may be oscillated for a distance that is greater than the combined width of the edge folds. For example, if each edge fold is approximately ¼ inch, the film may be oscillated approximately ⅝ inch to prevent stacking. The oscillation rate may range from 1 to 20 cycles per minute, with a preferred rate of approximately 7.5 cycles per minute.

Figure 4:
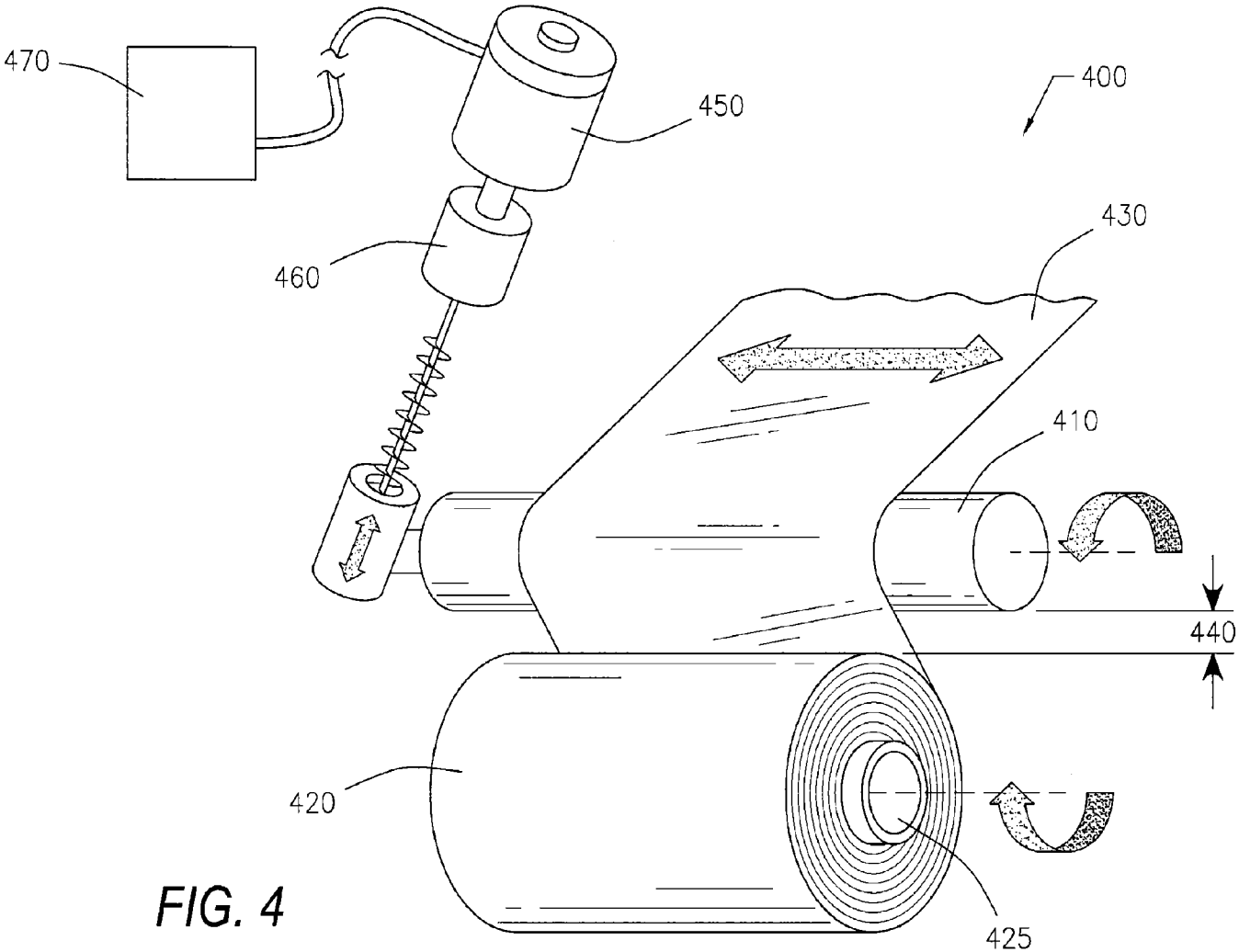
FIG. 4 illustrates the winding mechanism, according to an embodiment described herein.

Entrapping air between the layers of film as the film is wound onto a film roll also makes the film easier to unwind and less susceptible to damage. As shown in FIG. 4, the winding mechanism 400 may be comprised of a retractable idler roll 410 and a film roll 420. The film roll 420 may begin as a core 425 onto which the film 430 is wound and may gradually increase in size as multiple layers of film 430 are wrapped around the core 425.

The film 430 may pass over the retractable idler roll 410, which moves away from the film roll 420 at a separation rate as the film roll 420 increases in size. The separation rate may maintain a constant distance between the retractable idler roll 410 and the surface of the film roll 420, described as an air gap 440. The air gap 440 may be consistently maintained throughout the winding process in order to trap air between the layers of film 430 as they are wound onto the film roll 420. The air gap 440 may be relatively short in order to maintain the appropriate level of air entrapment and to ensure proper oscillation of the film 430. For example, the air gap 440 may range from 0 to 5 inches, with a preferred distance of approximately one inch.

A mechanical system may be used to control the retractable idler roll 410. The types of mechanical systems that may be used include, but are not limited to, motor driven jack screw assemblies 450-460, linear actuators, cams, pneumatically driven systems, and hydraulically driven systems. The mechanical system may be operated and controlled by any conventional method, including, but not limited to, a programmable logic control (PLC) system 470 located within the winding mechanism 400.

From the foregoing, it will be understood by persons skilled in the art that devices, systems, and methods have been provided for oscillating the film and entrapping air between the layers of film as they are wound onto a film roll. While the description contains many specifics, these should not be construed as limitations on the scope of the present disclosure, but rather as an exemplification of the preferred embodiments thereof. The foregoing is considered as illustrative only of the principles of the present disclosure. Further, because numerous modifications and changes will readily occur to those skilled in the art, it is not desired to limit the present disclosure to the exact methodology shown and described, and accordingly all suitable modifications and equivalents may be resorted to, falling within the scope of the present disclosure. Although this disclosure has been described in its preferred form with a certain degree of particularity, it is understood that the present disclosure of the preferred form has been made only by way of example and numerous changes in the details of the method may be resorted to without departing from the spirit and scope of the present disclosure.

What is claimed is:

1. An apparatus for producing a film roll in-process, the apparatus comprising a film with edge folds, each edge fold having a width;

an oscillating mechanism that oscillates the film for an oscillation rate at an oscillation distance; and a winding mechanism that receives the film from the oscillating mechanism, comprising a retractable idler roll that is parallel to a film roll and moves vertically away from the film roll at a separation rate that maintains an air gap between the retractable idler roll and the film roll as the film is wound onto the film roll horizontally.

2. The apparatus according to claim 1, wherein the oscillation rate varies from 1 to 20 cycles per minute.

3. The apparatus according to claim 2, wherein the oscillation rate is approximately 7.5 cycles per minute.

4. The apparatus according to claim 1, wherein the oscillation distance is greater than the combined width of the edge folds.

5. The apparatus according to claim 4, wherein the oscillation distance is approximately ⅛ inch greater than the combined width of the edge folds.

6. The apparatus according to claim 1, wherein a mechanical system is used to control the retractable idler roll and to maintain the air gap.

7. The apparatus according to claim 6, wherein the mechanical system is chosen from the group consisting of jack screw assemblies, linear actuators, cams, pneumatically driven systems, and hydraulically driven systems.

8. The apparatus according to claim 1, wherein a mechanical system controls the separation rate at which the retractable idler roll moves away from the film roll.

9. The apparatus according to claim 8, wherein the mechanical system is operated by a programmable logic control (PLC) system.

10. The apparatus according to claim 1, wherein the air gap between the retractable idler roll and the film roll varies from 0 to 5 inches.

11. The apparatus according to claim 10, wherein the air gap between the retractable idler roll and the film roll is approximately 1 inch.

12. An in-process method for winding film onto a film roll, the method comprising the steps of providing a film with edge folds, each edge fold having a width;

oscillating the film with an oscillating mechanism;

passing the film over a retractable idler roll that is parallel to the film roll and move vertically away from the film roll at a separation rate that maintains a distance between the retractable idler roll and the film roll;

passing the film across the distance; and winding the film onto the film roll horizontally.

* * * * *